United States Patent [19]

Hofmeister

[11] Patent Number: 4,890,570

[45] Date of Patent: Jan. 2, 1990

[54] WIND PROPELLED SAILING CRAFT

[76] Inventor: Rodney V. Hofmeister, 13338 Stephenson, Anchorage, Ak. 99515

[21] Appl. No.: 307,003

[22] Filed: Feb. 7, 1989

[51] Int. Cl.[4] ..... B63B 35/00

[52] U.S. Cl. ..... 114/39.1; 114/61; 114/123

[58] Field of Search ..... 114/39.1, 39.2, 61, 114/123, 144 R, 292

[56] References Cited

U.S. PATENT DOCUMENTS

| | | | |
|---|---|---|---|
| 3,509,842 | 5/1970 | Mitchell | 114/61 |
| 3,566,819 | 3/1971 | Keddie | 114/61 |
| 4,401,047 | 8/1983 | Auras | 114/39 |
| 4,621,587 | 11/1986 | Pool | 114/61 |
| 4,662,297 | 5/1987 | Crowley et al. | 114/61 |
| 4,715,306 | 12/1987 | Horais | 114/61 |

FOREIGN PATENT DOCUMENTS

| | | | |
|---|---|---|---|
| 3318638 | 11/1984 | Fed. Rep. of Germany | 114/61 |
| 8400134 | 1/1984 | World Int. Prop. O. | 114/39.2 |

*Primary Examiner*—Joseph F. Peters, Jr.
*Assistant Examiner*—Jesus D. Sotelo
*Attorney, Agent, or Firm*—Henderson & Sturm

[57] ABSTRACT

A wind propelled sailing craft. The craft includes a frame with fore-and-aft beams interconnected by transverse beams. A deck is attached to the frame where the operator will sit on a trampoline. A sail-like structure is attached to the frame and extends upwardly from the deck. A pair of elongated hulls are disposed laterally of each other and include a pair of fore-and-aft spaced upwardly extending pedestals to pivotally receive one of the fore-and-aft beams of the frame. Each hull has attached at its tail end a rudder. A rudder bar is attached to and interconnects each of the hulls and the rudder attached to the opposite hull. A tiller is pivotally attached to the transverse beams of the frame and tie rods interconnect the hulls and the tiller. When the pilot moves the operator bar of the tiller, it acts to simultaneously move both hulls and both rudders to turn the craft.

12 Claims, 3 Drawing Sheets

WIND PROPELLED SAILING CRAFT

TECHNICAL FIELD

This invention relates to sailing craft and more particularly to wind propelled sailing craft.

BACKGROUND ART

There are many prior art wind propelled sailing craft in the prior art. U.S. Pat. No. 4,401,047 discloses a craft with articulated joints and has framework and propulsion means relative to trim while maintaining level positioning of the flat-bottomed floats in relation to the medium being traversed. The floats do not heel into the water. The hulls do not increase turning with this craft.

U.S. Pat. No. 4,621,587 to Pool discloses an assembly that includes kayak-type canoe hulls joined by the frame of a trampoline. The hulls are maintained by tabernacles on the two hulls which fit into four components on the trampoline frame. The said mast rests on the trampoline.

U.S. Pat. No. 4,662,297 discloses a craft which is easily transported by one person in a disassembled configuration. No special tools or equipment are required for assembly or disassembly. The hulls are ski-like members and house a trampoline member and a sail. The craft can also be maneuvered by use of paddles or an outboard motor.

U.S. Pat. No. 4,715,306 discloses a steerable apparatus mounted on the deck of a catamaran. A board is mounted to the housing to permit movement between an upper and lower position. A tiller is attached by rope or elastic cord and hooks on the deck to prevent unwanted movement. The deck is secured to the hulls by a seat-belt like structure.

All known devices have structure that limits the maneuverability of the craft. Those concerned with this and other problems recognize the need for an improved sailing craft.

Disclosure of the Invention

The present invention provides a wind propelled sailing craft. The craft includes a frame with fore-and-aft beams interconnected by transverse beams. A deck is attached to the frame where the operator will sit on a trampoline. A sail-like structure is attached to the frame and extends upwardly from the deck. A pair of elongated hulls are disposed laterally of each other and include a pair of fore-and-aft spaced upwardly extending pedestals to pivotally receive one of the fore-and-aft beams of the frame. Each hull has attached at its tail end a rudder. A rudder bar is attached to and interconnects each of the hulls and the rudder attached to the opposite hull. A tiller is pivotally attached to the transverse beams of the frame and tie rods interconnect the hulls and the tiller. When the pilot moves the operator bar of the tiller, it acts to simultaneously move both hulls and both rudders to turn the craft.

An object of the present invention is the provision of an improved wind propelled sailing craft.

Another object of the present invention is to provide a wind propelled sailing craft that allows changing of sailing position without changing the sail position.

A further object of the invention is the provision of a wind propelled sailing craft that increases turning speed by the design of the hulls.

Still another object of the present invention is to provide a wind propelled sailing craft that is safe and easy to use.

A still further object of the present invention is the provision of a wind propelled sailing craft that is inexpensive to manufacture.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figures 1, 3, 4:
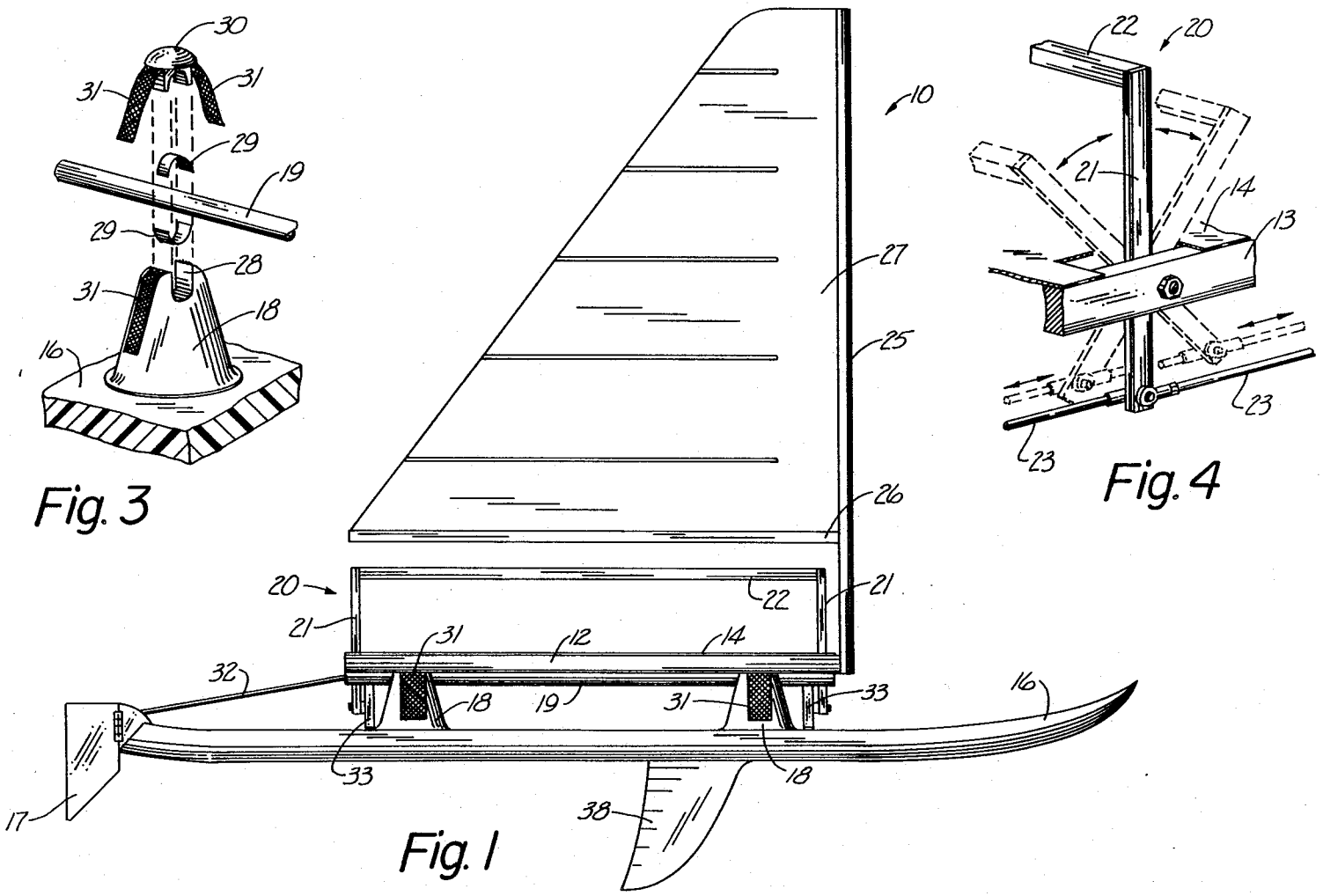
FIG. 1 is a side elevational view showing the sailing craft of the present invention.
FIG. 3 is an exploded perspective view illustrating the releasably pivotal connection of the hull pedestals and the fore-and-aft frame beams.
FIG. 4 is a partial perspective view showing one end of the operator bar of the tiller pivotally connected to the transverse beam of the frame and showing the connection to the laterally disposed tie rods to the lower portion of driven section of the operator bar, the range of motion of the tiller being illustrated by dash lines.

Referring now to the drawings, wherein like reference numerals designate identical or corresponding parts throughout the several views, FIG. 1 shows the wind propelled sailing craft (10) of the present invention.

Figure 2:
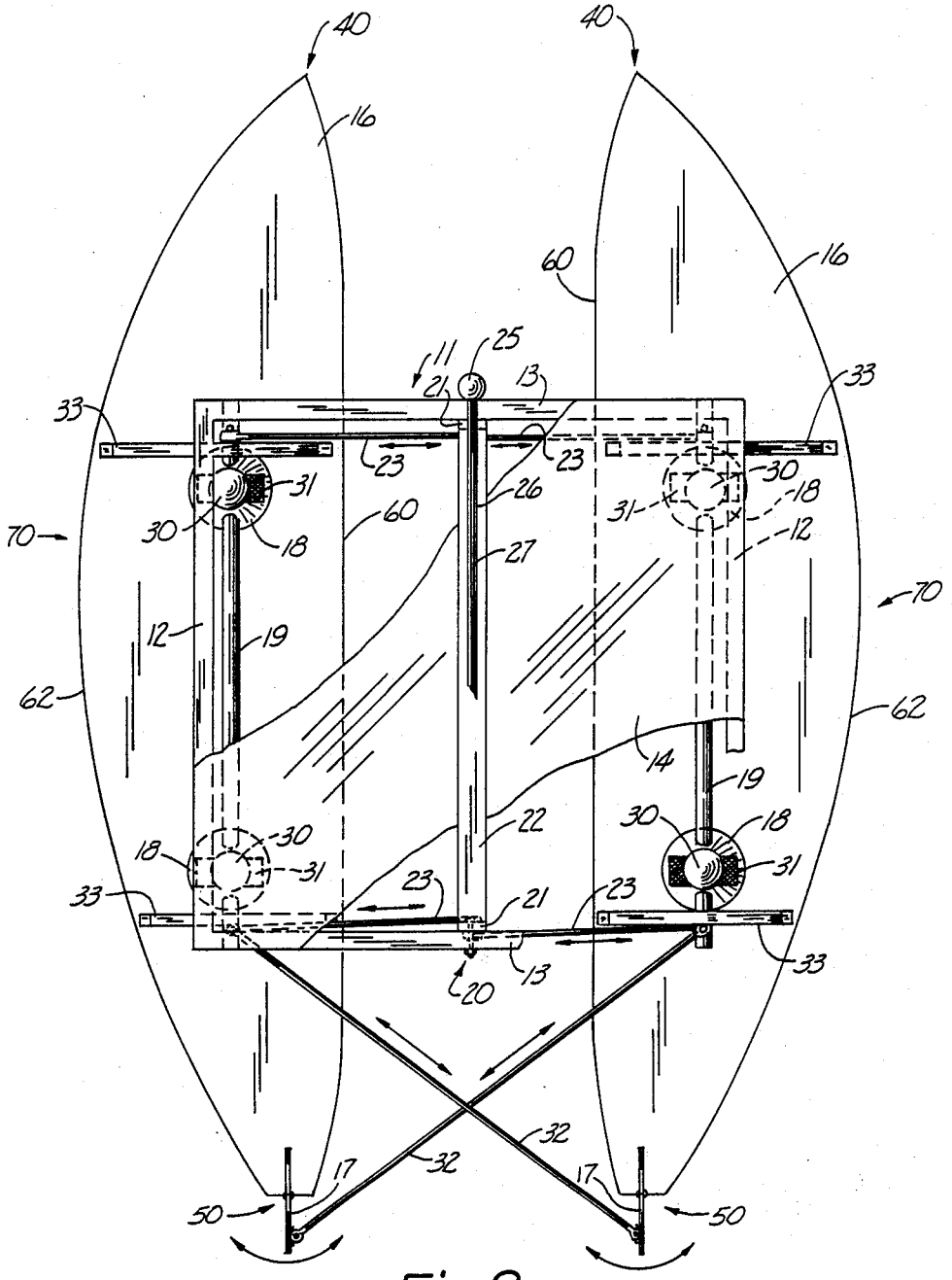
FIG. 2 is a top plan view thereof with portions cut away to more clearly shown the laterally disposed tie rods interconnecting the tiller and the hulls, and to show the diagonally disposed rudder bars interconnecting each of the hulls and the rudder of the opposite hull.

Referring now to FIGS. 1 and 2, the craft (10) includes a horizontally disposed frame (11) consisting of fore-and-aft beams (12), interconnected by transverse beams (13). A deck (14), such as a trampoline, is attached to the fore-and-aft beams (12) at each side and to the transverse beams (13) at each and secured in a manner well known in the art. A pair of low profiled, slightly V-shaped bulls (16), each having a downwardly depending stabilizer bar (38), a nose (40), a tail (50), a straight inside rail (60), and a curved convex outside rail (62), are disposed laterally of each other and connected together by the frame (11). Rudders (17) are attached to each hull (16) at the tail (50) thereof by a hinged mechanism to allow pivotal movement of the rudder (17). A pair of pedestals (18) are secured to each of the hulls

(16) for pivotally receiving fore-and-aft beams (19) which have a circular cross-section.

Tiller (20) consists of a pair of vertically disposed operator bars (21) interconnected by a horizontally disposed handle (22). Each operator bar (21) is pivotally attached to one of the transverse beams (13). Tie rods (23) interconnect a first operator bar (21) nearest the bow of the craft (10) and the hull posts (24) extending outwardly and downwardly from the inverted V-shaped supports (33). A second operator bar (21) nearest the stern of the craft (10) is connected by tie rods (23) to hull posts (24) and rudder bars (32) are attached to the stern end hull post (24) and extend back to the rudder (17) of the opposite hull (16). (FIGS. 5 and 6).

A mast (25) is secured to transverse beam (13) and horizontal boom (26) is attached to mast (25). A stationary sail (27) is secured to the mast (25) and boom (26).

Referring now to FIG. 3, the pedestal (18) is shown and includes an open notch (28) for receiving a beam (19) having a circular cross-section. A nylon sleeve (29) is of a split-ring type that encircles the beam (19) and fits into notch (28). A cap (30) fits snugly and securely over sleeve (29) to keep the beam (19) securely in place in notch (28) of pedestal (18). The cap (30) is releasably held in place by means of Velcro closures (31) or the like.

Figure 5:
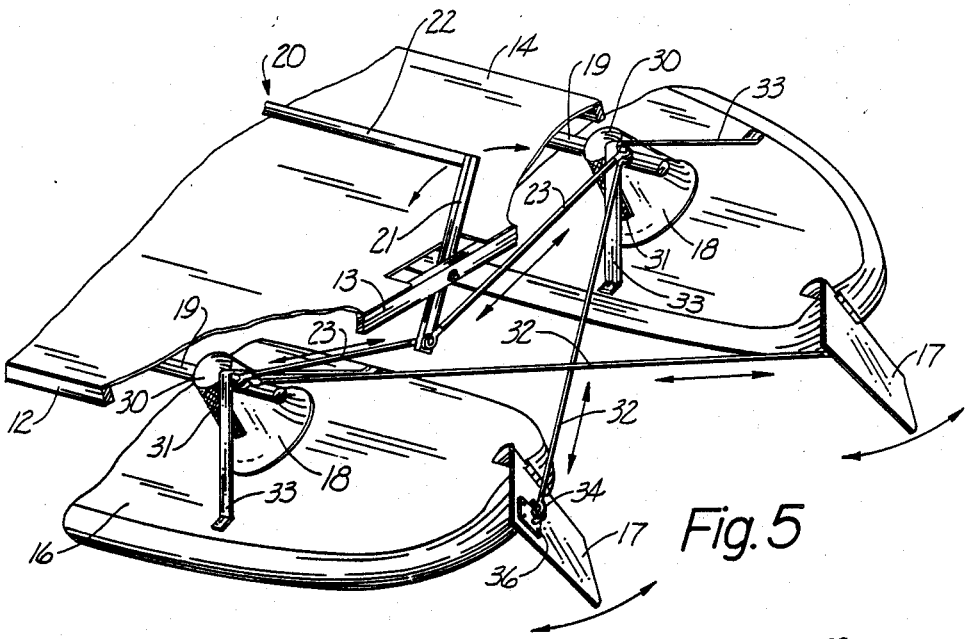
FIG. 5 is a partial perspective view with portions cut away to more clearly show the connection of the second operator bar located nearest the stern of the craft and the tie rods and rudder bars.
Figure 6:
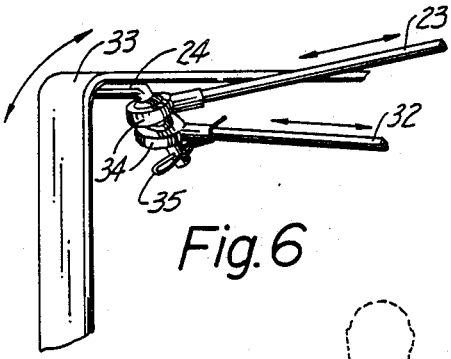
FIG. 6 is an enlarged partial perspective view showing the inverted V-shaped hull posts and the pivotal connection of a tie rod and and a rudder bar.
Figure 7:
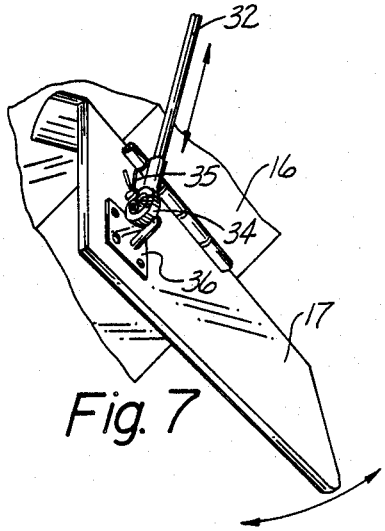
FIG. 7 is an enlarged partial perspective view showing the pivotal connection of the rudder bar to the rudder.

Referring to FIGS. 5, 6 and 7, the attachment of the tie rods (23) and rudder bars (32) to posts (24) is best shown. Post (24) is rigidly secured to support (33) by welding or the like. (FIG. 6) Tie rods (23) and rudder bars (32) are attached to the post (24) by ball and socket joints (34) and secured by a cotter pin (35). In FIG. 7, the hinged attachment of rudder (17) to hull (16) is shown. The rudder bar (32) is secured to the rudder (17) by means of a plate (36) and a cotter pin (35).

Figure 8:
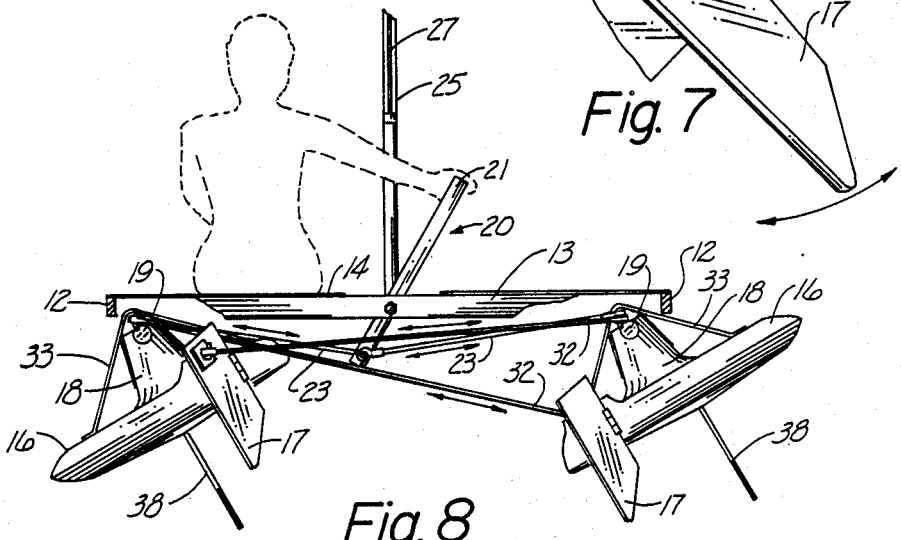
FIG. 8 is a rear elevational view illustrating the orientation of the tiller, the hulls, and the rudders when making a left-hand turn, it being understood that for a right-hand turn all these components would be inclined in the opposite direction.

FIG. 8 best depicts the craft (10) in use. In use, the pilot boards the craft (10) and sits on the trampoline deck (14). The sail (27) is then set by the pilot. To maneuver the craft (10), the pilot either pushes or pulls the handle (22) depending on the direction of the turn desired. When pushing the handle (22) to the right, the tie rods (23) act to pivot the hulls (16) in a counter-clockwise direction and the rudder bars (32) simultaneously pivot the rudders (17), thereby steering the craft (10) to the left. To steer straight ahead, the pilot positions the handle (22) so that the operator bars (21) are in an upright position. To steer to the right, the pilot reverses the above step.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A wind propelled sailing craft, comprising:

a frame including fore-and-aft beams interconnected by transverse beams;

a deck attached to said frame;

a wind propulsion structure attached to said frame and disposed to extend above said deck;

a pair of elongated hulls disposed in laterally spaced relationship, each of said hulls including a pair of fore-and-aft spaced upwardly extending pedestals adapted to receive one of said fore-and-aft beams of the frame for pivotal movement with respect thereto about a horizontal axis, each of said hulls including a nose, a tail, an inside rail and an outside rail;

a rudder pivotally attached to each of said hulls at said tail;

a tiller having an operator bar pivotally attached to one of said transverse beams, said operator bar including a drive section disposed to extend above said transverse beams and a driven section disposed to extend below said transverse beams;

tie rods pivotally attached to a lower portion of said driven section, said tie rods being laterally disposed to extend to a point of pivotal attachment on each of said hulls offset from said horizontal axis; and rudder bars pivotally attached to and interconnecting each of said hulls and the rudder attached to the opposite hull, whereby movement of the operator bar of the tiller by a pilot is translated to simultaneous pivotal movement of both hulls and both rudders to facilitate turning of the craft.

2. The craft of claim 1 wherein said fore-and-aft beams are circular in cross section.

3. The craft of claim 2 wherein each said pedestal includes:

an upwardly extending support rigidly attached to said hull and having a centrally disposed upwardly directed open notch;

a split-ring sleeve adapted to be received in said notch and adapted to encircle and pivotally receive a portion of said fore-and-aft beam;

a cap disposed to secure said sleeve in contact with said fore-and-aft beam; and means for releasably securing said cap to said support.

4. The craft of claim 3 wherein said releasable securing means includes a Velcro surface on said support adjacent said notch and Velcro straps attached to and depending from said cap.

5. The craft of claim 1 wherein said deck includes a trampoline attached to said frame.

6. The craft of claim 1 wherein said wind propulsion structure includes a vertical mast attached to one of said transverse beams, a horizontal boom attached to said mast and disposed to extend toward the stern of said craft, and a sail attached to said mast and boom.

7. The craft of claim 6 wherein said wind propulsion structure is stationary.

8. The craft of claim 1 wherein said hulls are low profiled with slight V bottoms.

9. The craft of claim 1 wherein said inside rail is substantially straight and said outside rail is curved convex.

10. The craft of claim 1 wherein said tiller includes:

a first operator bar pivotally attached to the transverse beam nearest the bow of the craft;

a second operator bar pivotally attached to the transverse beam nearest the stern of the craft; and a horizontally disposed handle attached to and interconnecting the upper portions of said operator bars.

11. The craft of claim 10 wherein said tie rods interconnect both said first operator bar and said second operator bar to posts attached to and extending upwardly from said hulls adjacent to each of said pedestals.

12. The craft of claim 11 wherein said rudder bars are attached to said posts nearest the stern of said craft.

* * * * *